US006808397B2

(12) United States Patent
Kondo

(10) Patent No.: US 6,808,397 B2
(45) Date of Patent: Oct. 26, 2004

(54) MOUNTING STRUCTURE OF CONNECTOR FOR USE WITH CIRCUIT BOARD

(75) Inventor: Hiroyuki Kondo, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/115,015

(22) Filed: Apr. 4, 2002

(65) Prior Publication Data

US 2002/0146918 A1 Oct. 10, 2002

(30) Foreign Application Priority Data

Apr. 6, 2001 (JP) ..... 2001-108242

(51) Int. Cl.[7] ..... H01R 12/00
(52) U.S. Cl. ..... 439/76.2; 439/79; 439/82
(58) Field of Search ..... 439/76.2, 79, 78, 439/80, 81, 83

(56) References Cited

U.S. PATENT DOCUMENTS 3,676,746 A 7/1972 Kassabgi et al.
4,964,806 A * 10/1990 Sakamoto et al. ..... 439/79
5,085,590 A 2/1992 Galloway
5,186,633 A 2/1993 Mosser, III
6,155,863 A * 12/2000 Matsuzaki et al. ..... 439/353
6,341,961 B1 * 1/2002 Juntwait ..... 439/63

FOREIGN PATENT DOCUMENTS

EP 0 552 622 A1 7/1993

* cited by examiner

*Primary Examiner*—Ross Gushi
*Assistant Examiner*—Briggitte R. Hammmond
(74) *Attorney, Agent, or Firm*—Armstrong, Kratz, Quintos, Hanson & Brooks, LLP

(57) ABSTRACT

A mounting structure of a connector 6 for use with a circuit board 7 includes fixing parts 8 provided on one side of the connector 6 and fixed to the circuit board 7, terminals 25 contained in the connector and connected to the circuit board by soldering, a plurality of wiring boards $\mathbf{4}_1$ to $\mathbf{4}_2$ arranged adjacent to the circuit board, and a pair of support walls 9 provided on the other side of the connector 6 and projected from the connector. The support walls 9 are abutted at their lower ends against the uppermost wiring board $\mathbf{4}_1$, enabling the connector to be supported by both the support walls 9 and the fixing parts 8. The fixing parts 8 and the support walls 9 are projected in directions intersecting at a right angle so that the support walls 9 may be abutted against the wiring board $\mathbf{4}_1$ in an engaging direction of a mating connector 37. The support walls 9 are projected longer than the terminals 25 toward the wiring board $\mathbf{4}_1$.

12 Claims, 5 Drawing Sheets

MOUNTING STRUCTURE OF CONNECTOR FOR USE WITH CIRCUIT BOARD

BACKGROUND OF THE INVENTION

1. Field of the Invention

The present invention relates to a mounting structure of a connector for use with a circuit board contained in an electrical junction box for motor vehicles or the like, and more particularly, to the mounting structure in which the connector is fixed to the circuit board, and at the same time, the connector is supported on wiring boards thereby to reinforce fixation force of the connector.

2. Description of the Related Art

FIG. 7 shows an example of a conventional mounting structure of a connector for use with a circuit board.

The connector 51 for use with the circuit board (hereinafter referred to as "board side connector") is incorporated into an electrical junction box (not shown) in a state fixed to a vertical circuit board 7 by means of male screw members 40. The board side connector 51 is vertically positioned, and horizontally projecting fixing parts 8 are fixed to the circuit board 7 by means of the above mentioned male screw members 40 such as small screws, bolts, etc.

Threaded portions (shaft portions) 40*a* of the male screw members 40 are screwed into the fixing parts 8 respectively through holes formed in the circuit board 7, with their heads 40*b* pressed on one face of the circuit board 7 while the fixing parts 8 are pressed on the other face of the circuit board 7, thereby clamping the circuit board 7 between the heads 40*b* and the fixing parts 8. The fixing parts 8 are formed of synthetic resin integrally with a connector housing 52 and provided with holes having a smaller diameter than the threaded portions 40*a*, into which the threaded portions 40*a* are forcibly screwed in a tap-like manner. It is also possible to provide nuts which are female screw members and embedded in the fixing parts 8. Because this incurs an increase of cost, however, the tap-like screwing method has been generally employed.

The board side connector 51 is of a female type having a connector engaging chamber 53. A male type connector 37 to be mated is inserted for engagement into the connector engaging chamber 53 through an upper opening 53*a*. The male type connector 37 is attached to an end of a wire harness for example, and contains female type terminals (not shown) insider In the connector engaging chamber 53 of the board side connector 51, are positioned one of electrical contact portions 26 of a plurality of plate-like or pin-like male type terminals 25 which are bent in a substantially L-shape, protruding in a vertical direction. Portions rectilinearly continued from the one electrical contact portions 26 are passed through a bottom wall of the connector housing 52, and bent at an angle of 90° outside the connector housing 52. The other electrical contact portions 27 extending in a horizontal direction are passed through holes in the circuit board 7 to be fixed for connection to a printed circuit on the circuit board 7 by soldering 41. The printed circuit is formed in a desired pattern on a board face at a side where the heads 40*b* of the male screw members 40 are adapted to contact. In place of the printed circuit, it is possible to form other types of circuits such as a copper foil circuit. The one portions 26 of the male type terminals 25 are fixed to the bottom wall 54 of the connector housing 52 by pressure fitting or insert molding.

The circuit board 7 is contained in the electrical junction box in a state supported by a lower case 5, and the board side connector 51 is engaged in a hole in an upper case (not shown) so as to project slightly upward of the hole. A plurality of bus bar wiring boards 4 are stacked and horizontally arranged above the lower case 5. The lower case 5 and the upper case constitute a junction box body formed of synthetic resin.

However, in the conventional mounting structure of the connector for use with the circuit board as described above, when the mating male type connector 37 is inserted into the board side connector 51 from the above, the board side connector 51 is pressed downward by an action of leverage at joints between the fixing parts 8 and the male screw members 40 as fulcrums, and tends to be flexed. In this case, there has been such an anxiety that the male type terminals 25 may be flexed integrally, and may strain the soldered parts 41 between the circuit board 7 and the male type terminals 25, causing cracks in the soldered parts.

Moreover, there has been such an anxiety that excessive force may be exerted on the joints between the fixing parts 8 of the board side connector 51 and the male screw members 40, and the circuit board 7 may be likely to be deformed or damaged. Further, because the board side connector 51 pushed by the mating connector 37 is slightly inclined together with the one electrical contact positions 26 of the terminals 25, insertion of the mating connector 37 into the connector engaging chamber 53 cannot be smoothly performed. As the results, insertion force of the connector 37 will be increased to deteriorate its insertion ability, and at the same time, both the connectors 37 and 51 as well as the terminals in the connectors 31, 51 may be pried by each other and apt to be damaged.

The above described problems may also occur, when the circuit board 7 or the board side connector 51 is arranged horizontally instead of vertically, and the mating connector 37 is engaged with the board side connector 51 from the side.

In view of the above, an object of the present invention is to provide a mounting structure of a connector for use with a circuit board which facilitates smooth engagement and connection of the connector with a mating connector, without straining soldered parts between the circuit board and terminals, the terminals themselves, the fixing parts of the connector, or the circuit board.

SUMMARY OF THE INVENTION

In order to attain the above described object, there is provided, according to the present invention, a mounting structure of a connector for use with a circuit board comprising a fixing part provided on one side of the connector and fixed to the circuit board, terminals contained in the connector and connected to the circuit board by soldering, at least one wiring board arranged adjacent to the circuit board, and a supporting part provided on the other side of the connector and projected from the connector, wherein the supporting part is abutted against the wiring board enabling the connector to be supported by both the supporting part and the fixing part.

In the above described structure, because one side of the connector for use with the circuit board is supported by the circuit board at the fixing part, while the other side of the connector is supported by the wiring board at the supporting part, the connector can be supported on both sides and prevented from being inclined with respect to the fixing part as a fulcrum when the connector is engaged with a mating connector. As the results, excessive force will not be exerted on soldered joints between the terminals and the circuit board, and cracks, of the soldered joints, damage or deformation of the circuit board at the fixing part, etc. will be prevented. Accordingly, smooth engagement with the mating connector can be performed without prying.

In the mounting structure of the connector for use with the circuit board according to another aspect of the present invention, the fixing part and the supporting part are projected in directions intersecting at a right angle, and the supporting part is abutted against the wiring board in a direction in which the mating connector is engaged with the connector.

In the above described structure, the projecting direction of the supporting part is in conformity with a direction of the pressure of the mating connector when the mating connector is engaged with the connector. Therefore, since no bending force is applied to the supporting part, the supporting part will not be flexed, but can firmly receive the pressure of the mating connector.

In the mounting structure of the connector for use with the circuit board according to still another aspect of the present invention, a pair of the supporting parts are provided on both sides of the connector.

In the above described structure, the connector for use with the circuit board can be supported by the supporting parts on both sides in a stable manner, and will be prevented from being inclined in a lateral direction (in a direction in parallel to the circuit board).

In the mounting structure of the connector for use with the circuit board according to a further aspect of the present invention, a pair of the supporting parts are formed in a wall-like shape, and the terminals are surrounded by the supporting parts to be positioned therein.

In the above described structure, the terminals are surrounded by the supporting parts and protected from an interference with the exterior. Moreover, an area of the connector to be abutted against the circuit board will be increased owing to the wall-like supporting parts, and can withstand still larger force on occasion of engagement of the connectors, interference with the exterior or so.

In the mounting structure of the connector for use with the circuit board according to a still further aspect of the present invention, the supporting part is projected longer than the terminals toward the wiring board.

In the above described structure, since interference of the terminals with the wiring board will be prevented, deformation or damage of the terminals and the wiring board, short circuit between them, etc. will be avoided.

In the mounting structure of the connector for use with the circuit board according to a still further aspect of the present invention, the circuit board and the wiring board are contained in a junction box body, and the connector is positioned in an insertion hole formed in the junction box body.

In the above described structure, as the circuit board and the wiring board are held in the junction box body, the pressure when the mating connector is engaged with the connector can be firmly received by cooperation of the fixing part, the circuit board, and the junction box body, as well as by cooperation of the supporting part, the wiring board, and the junction box boy. The connector for use with the circuit board is engaged in the insertion hole of the junction box body and retained without a backlash. An electrical junction box is constituted at least by the circuit board, the connector, the wiring board, and the junction box body.

DESCRIPTION OF THE PREFERRED EMBODIMENTS

Figure 1:
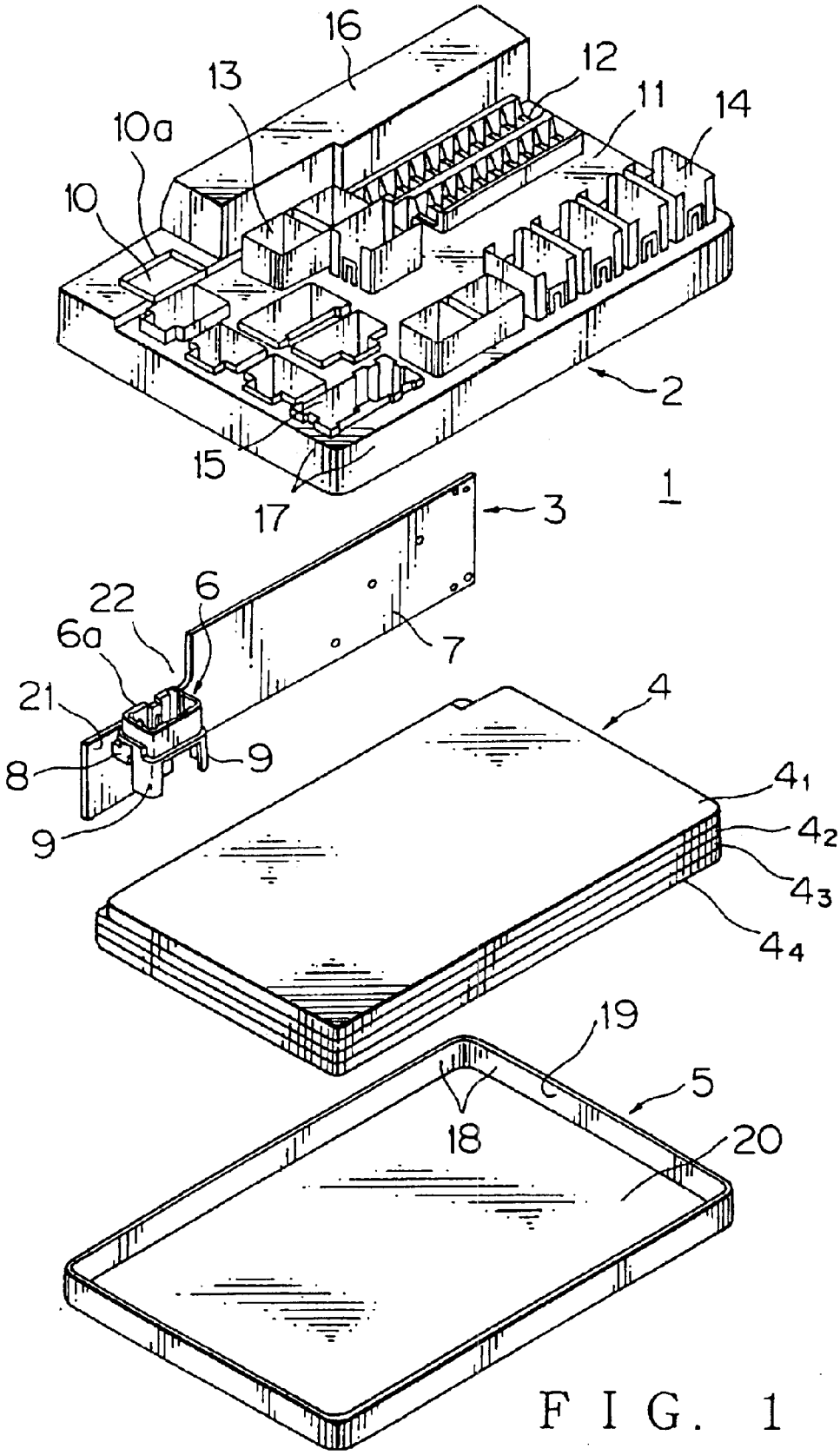
FIG. 1 is an exploded perspective view showing an embodiment of a mounting structure for a connector for use with a circuit board according to the present invention.

Now, an embodiment of the present invention will be described in detail referring to the drawings.

FIGS. 1 to 6 show an embodiment of a mounting structure of a connector for use with a circuit board according to the present invention.

As shown in FIG. 1, this mounting structure is applied to a connector 6 for use with a circuit board (hereinafter referred to as "board side connector") in an electrical junction box 1. The electrical junction box 1 contains a stack 4 of a plurality of horizontal bus bar wiring boards $\mathbf{4}_1$, to $\mathbf{4}_4$ between an upper case 2 and a lower case 5 (a junction box body) which are formed of synthetic resin. A vertical electronic circuit board 7 is arranged adjacent to the stack 4 of the wiring boards on its longitudinal side. The board side connector 6 is fixed to the electronic circuit board 7 by means of fixing parts 8 in such a manner that a pair of supporting walls 9 at a skirt of the board side connector 6 are abutted against an upper face of the uppermost bus bar wiring board $\mathbf{4}_1$. In this manner, fixing strength of the board side connector 6 with respect to the electronic circuit board 7 will be enhanced. The board side connector 6 is then positioned in a connector insertion hole 10 formed in the upper case 2.

As shown in FIG. 1, a plurality of fuse mounting parts 12, fusible link mounting parts 13, relay mounting parts 14, and connector mounting parts 15 are formed on an upper wall 11 of the upper case 2. In addition, there is formed an upwardly swelled containing part 16 for receiving the electronic circuit board 7 in a longitudinal side of the upper wall 11. In a corner area of the upper case 2 adjacent to the containing part 16 in a longitudinal direction and the connector mounting part 15 in a lateral direction, there is formed the above described connector insertion hole 10 in a rectangular shape.

A peripheral edge 10*a* of the connector insertion hole 10 is slightly projected upward. In the mounting parts 12 to 15, upwardly directed plate-like or pin-like male terminals (not shown) are protruded from the bus bar wiring boards $\mathbf{4}_1$ to $\mathbf{4}_4$. The upper case 2 includes the upper wall 11, surrounding walls 17 and a lower opening (not shown), while the lower case 5 includes surrounding walls 18 on four sides, an upper opening 19, and a bottom wall 20.

Fuses (not shown) to be inserted into the fuse mounting parts 12 are employed for small electric current, and fusible links (not shown) to be inserted into the fusible ling mounting parts 13 are employed for large electric current. Relays (not shown) to be inserted into the relay mounting parts 14 are adapted to open or close circuits (not shown) connected to the electronic circuit board 7 and the bus bar wiring boards $\mathbf{4}_1$ to $\mathbf{4}_4$ by on-off of contacts. Connectors (not shown) to be inserted into the connector mounting parts 15 enable the bus bar wiring boards $\mathbf{4}_1$ to $\mathbf{4}_4$ to be connected to connected to wire harnesses (not shown) in the exterior. The board side connector 6 similarly enables the electronic circuit board 7 to be connected to the connectors of the wire harnesses (not shown) in the exterior. Number of the bus bar wiring boards $\mathbf{4}_1$ to $\mathbf{4}_4$ is not limited to four.

The electronic circuit board 7 includes an insulating board (denoted also by reference numeral 7), a printed circuit (not shown) formed in a pattern on a surface of the insulating board, and electronic components (not shown) such as resistors, diodes, capacitors and so on connected to required positions on the printed circuit. Near one end of the electronic circuit board 7, is fixed the board side connector 6. The electronic circuit board 7 and the board side connector 6 constitute a circuit board assembly 3. The electronic circuit board 7 has a rectangular cut-out 22 at a position lower than an upper end 6*a* of the board side connector 6 in a fixing part 21 with respect to the board side connector 6.

Figure 2:
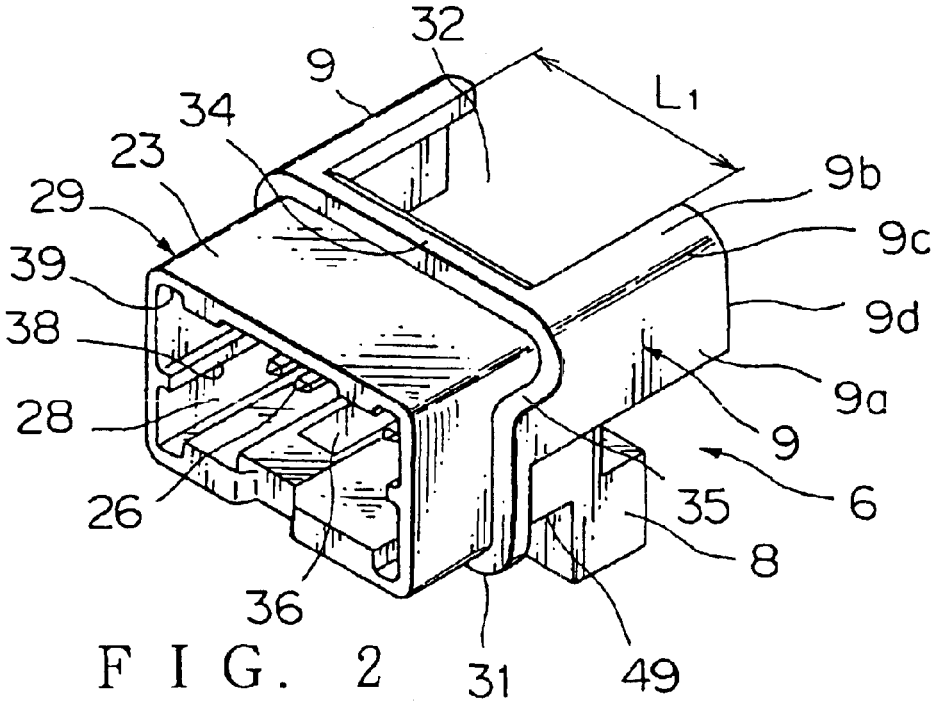
FIG. 2 is a perspective view showing an embodiment of the connector as seen from its distal end.
Figure 3:
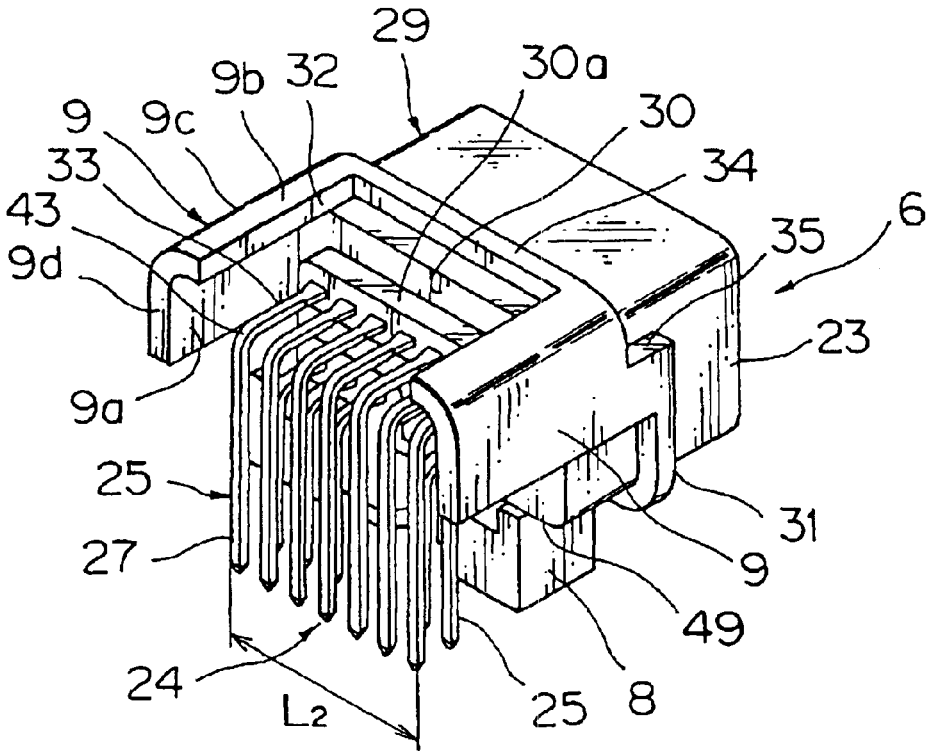
FIG. 3 is a perspective view showing the connector of FIG. 2 as seen from a back side.

The board side connector 6 has a connector engaging part 23 in its upper half, a board connecting part 24 and the aforesaid supporting walls 9 in its lower half, and the aforesaid fixing parts 8 in an intermediate area, as shown in two perspective views respectively in FIGS. 2 and 3. A plurality of pin-like male type terminals 25 which are rectangular in cross section and bent in a substantially L-shape have their electrical contact portions 26, 27 respectively disposed in the connector engaging part 23 and the board connecting part 24.

The connector engaging part 23 includes a surrounding wall (denoted also by reference numeral 23) in a rectangular shape and the one electrical contact portions 26 (FIG. 2) of the terminals 25 protruded into a connector engaging chamber 28 within the surrounding wall. The board connecting part 24 includes the other electrical contact portions 27 (FIG. 3) of the terminals 25 which are passed through a bottom wall 30 of a connector housing 29 formed of synthetic resin, and bent at an angle of 90° in a projecting direction of the fixing parts 8. The bottom wall 30 is formed to have a thick wall part 30*a* in an area through which the terminals are passed.

Each of the terminals 25 has the one, vertical electrical contact portion 26, a rectilinear portion 33 (FIG. 3) continued from the electrical contact portion 26 and passing through the bottom wall 30 of the connector housing 29, and the other electrical contact portion 27 horizontally extending below the bottom wall 30 via a bent portion 43.

The connector housing 29 is provided with a flange-like rib 31 which extends along substantially a half of its circumference to be integrally continued to a pair of the left and right supporting walls 9 in the other half of the circumference. Each of the supporting walls 9 is formed in a substantially L-shape in cross section, and includes a side wall portion 9*a* and a front wall portion 9*b* integrally connected by a curved portion 9*c*. A lower end 9*d* of the supporting wall 9 extends downward to be positioned below the horizontal electrical contact portions 27 of the terminals 25. The rib 31 serves to define an upper position (a length protruding out of the insertion opening 10) of the board side connector 6 by abutting, for example, against a back face of the upper case 2 in FIG. 1.

There is formed a rectangular opening 32 between the front wall portions 9*b* of a pair of the supporting walls 9. An inner width L1 (FIGS. 2 and 5) of the opening 32 is slightly larger than a width L2 (FIGS. 3 and 5) of a plurality of the terminals 25 so that the terminals 25 can be visually observed through the opening 32. As illustrated in FIG. 3, the supporting walls 9 act as hoods for covering the vertical portions 33 at roots of the terminals 25 (at least the terminals 25 in an outside row of two rows which are arranged back and forth) from both sides, thus protecting the terminals from interference with the exterior. With this structure, the terminals 25 will be prevented from being crooked or deformed. The terminals 25 in an inside second row are covered and protected by the terminals 25 in the outside first row. The terminals 25 in the inside row are formed shorter in their entire length than the terminals 25 in the outside row.

A pair of the supporting walls 9 are connected by a rib 34 at an upper edge of the opening 32. Because the support walls 9 are formed in a substantially L-shape in cross section and connected by the rib 34, mechanical strength of the support walls 9 is enhanced. The rib 34 on the front side is integrally continued to the rib 31 on the back side via a step 35 near base ends of the support walls 9.

The fixing parts 8 are projected from a back wall 49 of the connector housing 29 at a right angle, that is, in a direction intersecting the connector engaging direction, at a position lower than the rib 31. Numeral 36 in FIG. 2 designates an engaging groove corresponding to a protuberance of a flexible lock arm (not shown) of a mating connector 37 (FIG. 6), numerals 38 and 39 designate guide ribs and guide groove respectively, corresponding to the mating connector 37.

Figure 4:
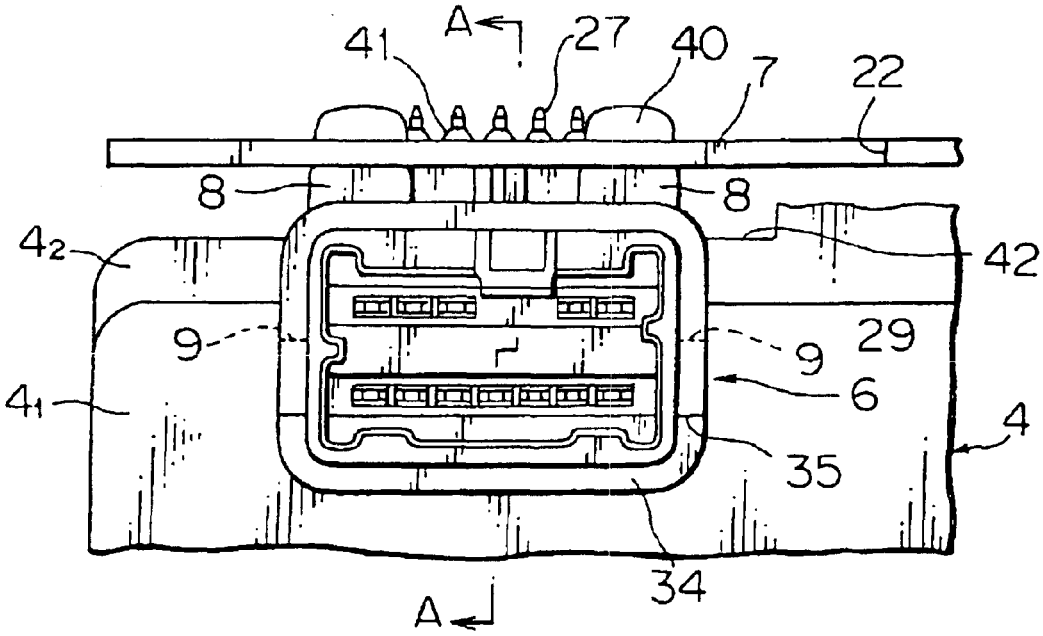
FIG. 4 is a plan view showing an essential part of the mounting structure of the connector fixed to the circuit board.

As shown in a plan view in FIG. 4, the fixing parts 8 of the board side connector 6 having a shape of square pillar are projected in a pair from a back face of the connector housing 29 in a horizontal direction, and fixed to a vertical electronic circuit board 7 by means of male screw members 40. Detailed description of the fixing parts 8 and the male screw members 40 will be omitted, because they have the same structures as described referring to the prior art. The other electrical contact portions 27 of the terminals 25 protrude longer than the fixing parts 8, passing through the electronic circuit board 7, and fixed to a printed circuit board (not shown) on a back face of the electronic circuit board 7. These structures are also the same as in the prior art, and a circuit made of a copper foil, etc. instead of the printed circuit can be also employed.

The aforesaid cut-out 22 of the electronic circuit board 7, the step 35 between the ribs 31 and 34, and the bus bar wiring boards $\mathbf{4}_1$, $\mathbf{4}_2$ are also shown in FIG. 4. The stack 4 of the wiring boards is positioned below the board side connector 6. The lower bus bar wiring board $\mathbf{4}_2$ is projected longer than the upper bus bar wiring board $\mathbf{4}_1$ and is slightly cut out at $\mathbf{4}_2$ in an area adjacent to the board side connector 6 as shown in FIG. 4. A lower end 7*a* (FIG. 6) of the electronic circuit board 7 is in contact with a bottom wall 20 (FIG. 5) of the lower case 5 below the stack 4 of the wiring boards.

Figure 5:
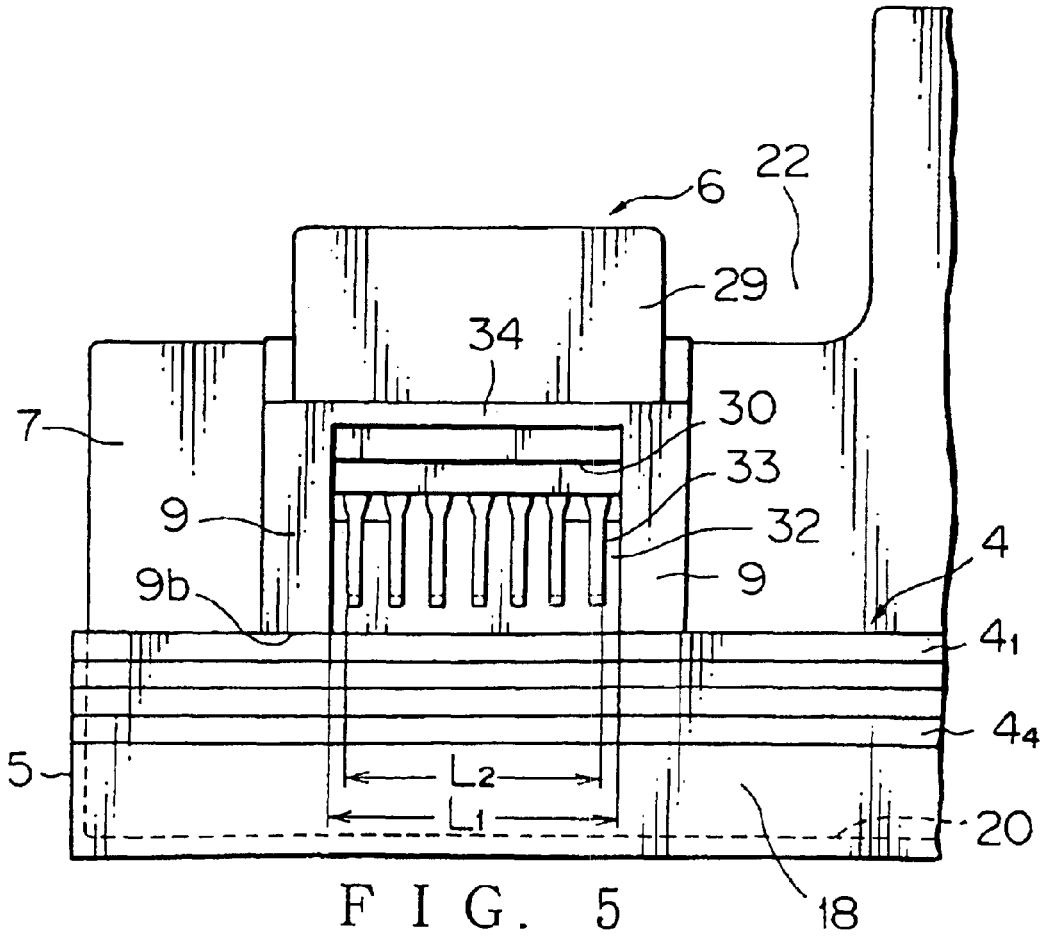
FIG. 5 is a front view showing the mounting structure of the connector fixed to the circuit board of FIG. 4.

Referring to FIG. 5, the bus bars (not shown) made of metal and having required patterns as electrically conductive circuits are provided on back faces of the bus bar wiring boards $\mathbf{4}_1$ to $\mathbf{4}_4$, and tab terminals (not shown) of the bus bars are passed through the uppermost bus bar wiring board $\mathbf{4}_1$, and the intermediate bus bar wiring boards $\mathbf{4}_2$, $\mathbf{4}_3$ to be erected at required positions. The bus bar wiring boards $\mathbf{4}_1$ to $\mathbf{4}_4$ are respectively composed of insulating boards, and the bus bars which are contained in grooves formed on lower faces of the insulating boards.

Figure 6:
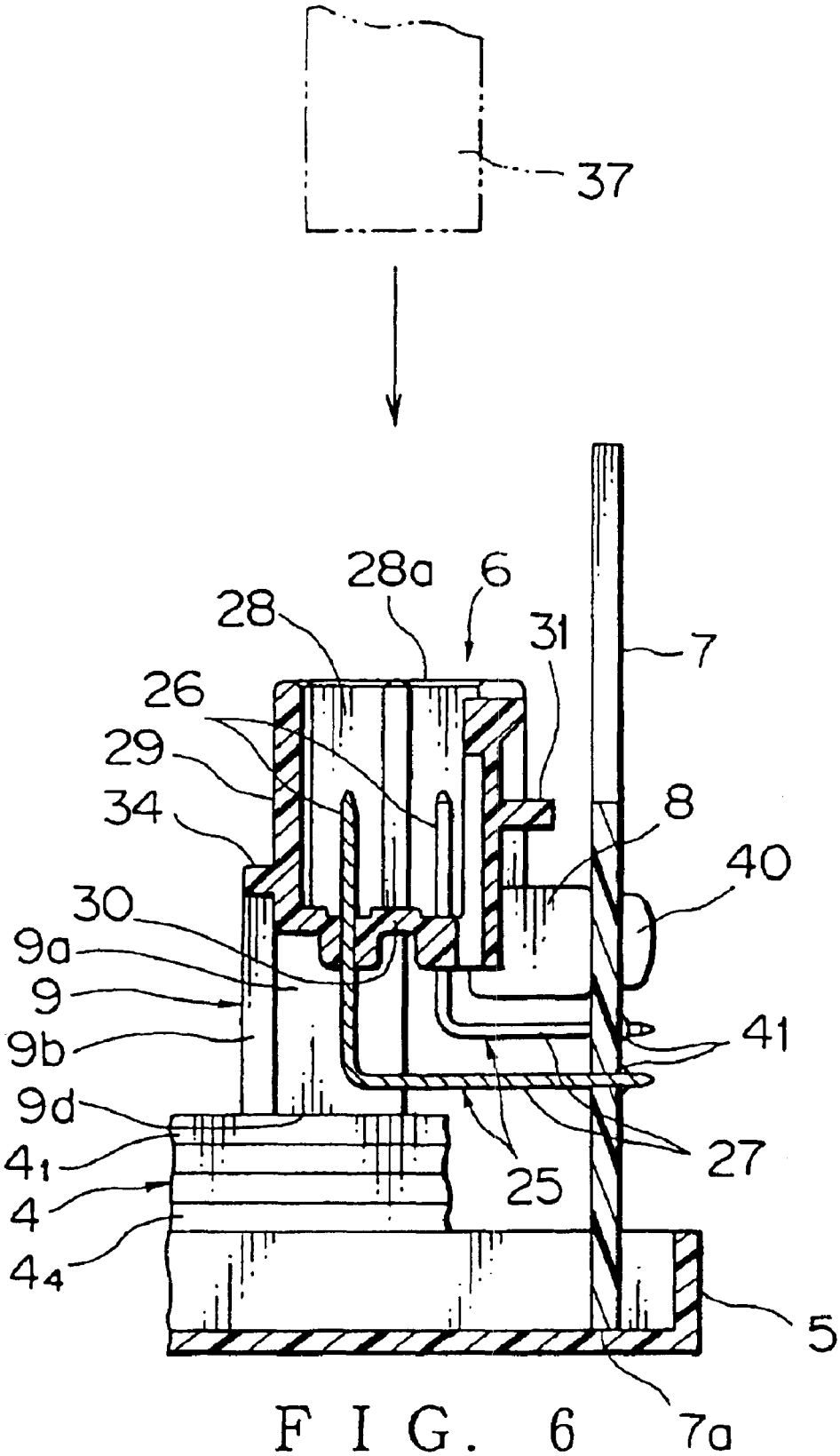
FIG. 6 is a sectional view taken along a line A—A of FIG. 4.
Figure 7:
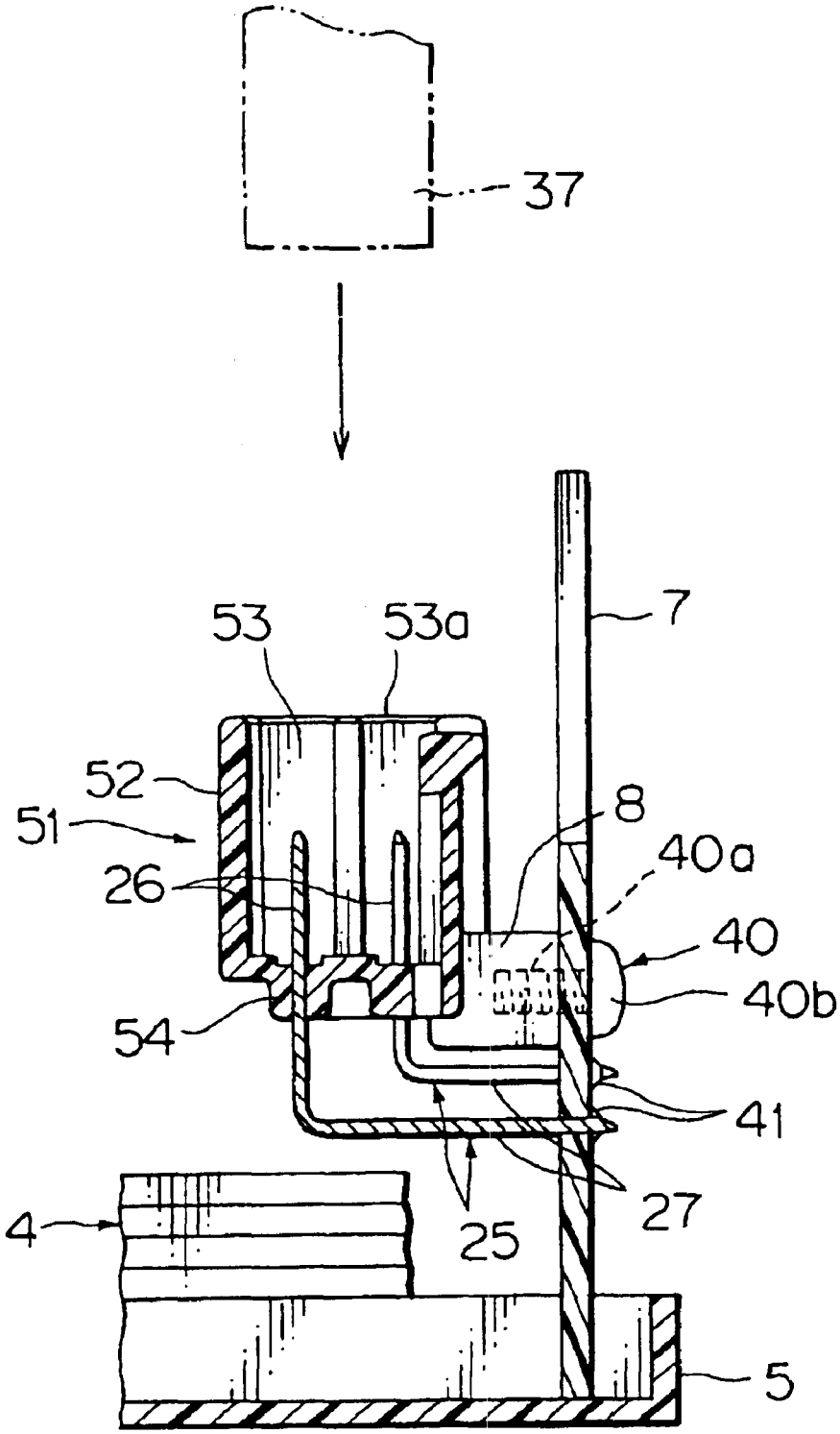
PRIOR ART FIG. 7
FIG. 7 is a vertical sectional view showing a conventional mounting structure of a connector for use with a circuit board.

The board side connector 6 is positioned above the stack 4 of the bus bar wiring boards, in such a manner that the lower end faces 9*d* of the support walls 9 are in contact with an upper face of the uppermost bus bar wiring board $\mathbf{4}_1$ as shown in FIGS. 5 and 6. The support walls 9 are integrally provided on the connector housing 29 on a side remote from the electronic 15 circuit board 7, that is, at an opposite side to the fixing parts 8. Accordingly, the support walls 9 can be held on the upper face of the wiring board. Moreover, the support walls 9 project in the engaging direction of the mating connector 37, and thus, the fixing members 8 and the support walls 9 project in directions intersecting each other. With this structure, the support walls 9 will not be flexed, and can reliably withstand the pressure of the mating connector 37.

In case where the bus bars are provided on the lower face of the insulating board of the bus bar wiring board $\mathbf{4}_1$, stability can be ensured, because the support walls 9 are abutted against a flat upper face of the insulating board. Even in case where the bus bars are provided on the upper face of the insulating board, the support walls 9 can be stably abutted against the upper faces of the bus bar wiring board $\mathbf{4}_1$, due to the fact that the bus bars are contained in the grooves on the upper face. Since the support walls 9 are formed of synthetic resin having insulating property, there will be no problem even if the support walls 9 come into contact with the bus bars.

Since the lower end faces of the support walls 9 are abutted against the upper face of the bus bar wiring board $\mathbf{4}_1$ as shown in FIGS. 5 and 6, the board side connector 6 integral with the support walls 9 can be supported on the bus bar wiring board $\mathbf{4}_1$. In this manner, the board side connector 6 is rigidly held at both sides by both the fixing parts 8 and the support walls 9, and so, when the mating male type connector 37 is inserted into the female type board side connector 6 into engagement, downward displacement of the board side connector 6 will be prevented, and the terminals 25 will not be flexed. As the results, exertion of excessive forces on the soldered parts 41 between the terminals 25 and the electronic circuit board 7 will be eliminated, and occurrence of cracks in the soldered parts 41 will be prevented. In addition, because the board side connector 6 will not be inclined, the two connectors 6 and 37 can be connected straightly and smoothly with a weak force, without prying, and thus, prying deformation or damage of the terminals in the connectors 6 and 37 will be prevented.

Pressure at the time of engagement of the connectors will be received by the stack 4 of the bus bar wiring boards via the support walls 9, and the pressure on the stack 4 of the bus bar wiring boards will be reliably received by the lower case 5. For example, the lowermost bus bar wiring board $\mathbf{4}_4$ is held in contact with an edge of the surrounding wall 18 (FIG. 5) of the lower case 5 or a support post (not shown) projected from the bottom wall. Alternatively, more than four sheets of the bus bar wiring boards may be stacked, and the lowermost bus bar wiring board may be abutted against the bottom wall 20 (FIG. 5) of the lower case 5, or against the support post projected from the bottom wall 20.

The pressure exerted on the fixing parts 8 are also reliably received by the lower case 5 via the electronic circuit board 7. It is also possible to allow the lower end 7*a* of the electronic circuit board 7 to be abutted against an upper face of the intermediate or the lower bus bar wiring board $\mathbf{4}_2$ $\mathbf{4}_4$.

In case where the rib 31 in the upper part of the board side connector 6 is abutted against the back face of the upper case 2 (FIG. 1), the upper case 2 can be locked with the lower case 5 by locking means (not shown) such as locking projections and locking holes, and at the same time, the board side connector 6 is clamped between the upper case 2 and the stack 4 of the bus bar wiring boards by means of the rib 31 and the support walls 9. As the results, a backlash of the board side connector 6 in a vertical direction can be prevented. This will also eliminate exertion of excessive force on the soldered parts 41 such as vibration, and the soldered parts 41 can be safely protected.

Although the terminals 25 are arranged in two rows back and forth as shown in FIGS. 4 and 6, the terminals 25 may be arranged in a single row or in more than three rows. It is also possible to rotate the board side connector 6 by 90 degree from a state in FIG. 6 to be arranged above the horizontally positioned electronic circuit board 7. In this state, an opening 28*a* of the connector engaging chamber 28 of the board side connector 6 is positioned in a horizontal direction, and the support walls 9 extending backward of the board side connector 6 can be abutted against the vertical bus bar wiring board 41. In this case, the distal end portion of the board side connector 6 will not project from the upwardly directed insertion hole 10 of the junction box body, but project from a laterally directed insertion opening to the exterior. The junction box body is composed of the upper case 2 and the lower case 3, for example.

Further, in place of the bus bar wiring boards $\mathbf{4}_1$ to $\mathbf{4}_4$, printed wiring boards may be used. It goes without saying, in this case, that the support walls 9 of the board side connector 6 are abutted against an upper face of the uppermost printed wiring board. By providing a conductive printed circuit of the printed wiring board on a back face of the insulating board, the support walls abutted against the printed wiring board will not badly affect the conductive circuit.

Although the present invention has been fully described by way of examples referring to the accompanying drawings, it is to be noted that various changes and modifications will be apparent to those skilled in the art.

What is claimed is:

1. A mounting structure of the connector for use with the circuit board comprising:

a fixing part provided on one side of said connector and fixed to said circuit board, terminals contained in said connector and connected to said circuit board by soldering, at least one wiring board arranged adjacent to said circuit board and a supporting part provided on the other side of said connector and projected from said connector, wherein said supporting part is abutted against said wiring board, thereby enabling said connector to be supported by both said supporting part and said fixing part, said fixing part and said supporting part are projected in directions intersecting at a right angle, and said supporting part is abutted against said wiring board in a direction in which a mating connector is engaged with said connector.

2. The mounting structure of the connector for use with the circuit board as claimed in claim 1, wherein said circuit board and said wiring board are contained in a junction box body, and said connector is positioned in an insertion hole formed in said junction box body.

3. The mounting structure of the connector for use with the circuit board as claimed in claim 1, wherein a pair of said supporting parts are provided on both sides of said connector.

4. The mounting structure of the connector for use with the circuit board as claimed in claim 3, wherein said circuit board and said wiring board are contained in a junction box body, and said connector is positioned in an insertion hole formed in said junction box body.

5. The mounting structure of a connector for use with the circuit board as claimed in claim 3;

wherein said pair of said supporting parts is formed as walls, and said terminals are surrounded by said walls of said supporting parts and positioned therein.

6. The mounting structure of the connector for use with the circuit board as claimed in claim 5, wherein said circuit board and said wiring board are contained in a junction box body, and said connector is positioned in an insertion hole formed in said junction box body.

7. The mounting structure of the connector for use with the circuit board as claimed in claim 1, wherein said supporting part is projected longer than said terminals toward said wiring board.

8. The mounting structure of the connector for use with the circuit board as claimed in claim 7, wherein said circuit board and said wiring board are contained in a junction box body, and said connector is positioned in an insertion hole formed in said junction box body.

9. The mounting structure of the connector for use with the circuit board as claimed in claim 3, wherein said supporting part is projected longer than said terminals toward said wiring board.

10. The mounting structure of the connector for use with the circuit board as claimed in claim 9, wherein said circuit board and said wiring board are contained in a junction box body, and said connector is positioned in an insertion hole formed in said junction box body.

11. The mounting structure of the connector for use with the circuit board as claimed in claim 5, wherein said supporting part is projected longer than said terminals toward said wiring board.

12. The mounting structure of the connector for use with the circuit board as claimed in claim 11, wherein said circuit board and said wiring board are contained in a junction box body, and said connector is positioned in an insertion hole formed in said junction box body.

* * * * *